US008496535B2

(12) United States Patent
Kaplan

(10) Patent No.: US 8,496,535 B2
(45) Date of Patent: Jul. 30, 2013

(54) RACKING FRAME KIT

(76) Inventor: Matthew Kaplan, Greenacres, FL (US)

( * ) Notice: Subject to any disclaimer, the term of this patent is extended or adjusted under 35 U.S.C. 154(b) by 171 days.

(21) Appl. No.: 13/114,897

(22) Filed: May 24, 2011

(65) Prior Publication Data

US 2012/0302361 A1 Nov. 29, 2012

(51) Int. Cl.
*A63D 15/00* (2006.01)

(52) U.S. Cl.
USPC ..... 473/40; 473/21; 473/26; 473/1; 473/41

(58) Field of Classification Search
USPC ..... 473/1, 21, 22, 26, 40, 41; D21/782; 206/315.9
See application file for complete search history.

(56) References Cited

U.S. PATENT DOCUMENTS

| | | | | |
|---|---|---|---|---|
| 230,652 | A | 8/1880 | Parker | |
| 294,200 | A * | 2/1884 | Collender | 473/41 |
| 501,256 | A | 7/1893 | Rohrbach | |
| 1,089,140 | A * | 3/1914 | Madigan | 473/40 |
| 1,093,123 | A * | 4/1914 | Goyette | 473/41 |
| 1,161,324 | A | 11/1915 | Matthay | |
| 1,299,471 | A * | 4/1919 | Hornbostel | 473/40 |
| 1,660,626 | A * | 2/1928 | Rhoads | 473/40 |
| 1,725,494 | A | 3/1928 | Varnum | |
| 3,423,087 | A | 1/1969 | Sowa | |
| 3,672,671 | A | 6/1972 | Merola | |
| 3,992,005 | A | 11/1976 | Richey | |
| 4,469,328 | A | 9/1984 | Pacitti | |
| 4,591,051 | A * | 5/1986 | Lowman | 206/315.9 |
| 4,984,788 | A | 1/1991 | Harriman | |
| 5,376,054 | A | 12/1994 | Kwasny et al. | |
| D367,306 | S * | 2/1996 | Fiscella | D21/782 |
| 5,529,540 | A | 6/1996 | Rozek | |
| 5,556,341 | A | 9/1996 | Bonn, Jr. | |
| 5,601,495 | A | 2/1997 | Silverman | |
| 5,735,750 | A | 4/1998 | Silverman | |
| 5,871,405 | A | 2/1999 | Sardo | |
| 5,916,032 | A | 6/1999 | Stoll | |
| 5,997,404 | A | 12/1999 | Sardo | |
| 6,261,187 | B1 * | 7/2001 | Tsai | 473/40 |
| 6,595,862 | B2 | 7/2003 | Porper | |
| D480,775 | S * | 10/2003 | Fischer | D21/782 |
| 7,491,130 | B2 | 2/2009 | Tudek et al. | |
| 2002/0107076 | A1 | 8/2002 | Porper | |
| 2009/0029787 | A1 | 1/2009 | Crosbie | |
| 2012/0302361 | A1 * | 11/2012 | Kaplan | 473/40 |

* cited by examiner

*Primary Examiner* — Mitra Aryanpour
(74) *Attorney, Agent, or Firm* — McHale & Slavin, P.A.

(57) ABSTRACT

A racking frame kit including a storage container housing three shaped side members that can assembled into an equilateral triangular enclosure for receipt of a group of balls in a compressed position. The racking frame providing a portable device that allows pool players to obtain the repeatability necessary from location to location. The kit further provides for the tightening of the formation of balls to obtain the maximum transfer of energy from a cue ball impact which will allow a predictable and disperse spread of balls across a playing surface. Various embodiments include a latching release, a magnet release, a tongue & groove release, and an elastic band.

8 Claims, 10 Drawing Sheets

RACKING FRAME KIT

FIELD OF THE INVENTION

This invention is related to the field of billiards, pool and snooker play and more particularly to an improved transportable racking frame kit.

BACKGROUND OF THE INVENTION

In the games of billiards, pool, and snooker, playing balls are arranged in a pre-determined pattern on a flat rectangular table. Full size snooker and English billiard tables are 12 feet long. Pool halls typically have 9 foot tables and smaller halls may have 7 foot tables. The tables provide a platform for the games wherein the balls are struck with a stick for moving them around the table which is bounded by rubber cushions. Billiards is a game played without pockets. Pool is a game played with six pockets, and hosting probably the most notable game known as 8-ball or pocket billiards. Snooker is technically a pocket billiards game and popular in view of its historic divergence from other games. These games all require a level of skill and are extremely popular with individuals of all ages.

In playing the game of pocket billiards, the balls are arranged on the surface of a pool table by use of a racking frame. The game of eight-ball employs fifteen balls placed within the racking frame and positioned on the table surface at the start of the game. The racking frame is triangular shaped and allows for ease of collecting the balls for movement onto a desired position. Once the balls have been properly positioned, the framing rack is removed leaving the balls on the table in a specific triangular formation. Once the rack is removed from the balls, the formation is broken by a player propelling a cue ball by use of the cue stick in such a manner as to disperse the formation of balls across the playing surface. The way in which the formation of balls is broken is of utmost importance to how the ensuing game progresses.

When forming the triangular shaped pattern of balls, it is desirable to compact the balls into a tight group to achieve the optimal break. A tight grouping of ball allows for a transfer of energy between the balls whereas a loose group will allow for the quick dissipation of energy and lead to an unpredictable scatting of the balls. The better players understand the need for a repeatable set up and the ability to transfer energy through the ball configuration. By being able to repeat the exact racking format, a truer "break" of the group of balls can be obtained when an individual strikes the grouping with a cue ball. With a high level of skill, a player is capable of placing individual balls into definite locations on the table. The ability for such precise performance is dependent on the form and angle of the cue ball's contact with the racked balls.

Even with a skilled user, a tight pattern is not easily obtained using a conventional racking frame. This is due to the fact that the racks ordinarily used are sized to define an enclosure which is slightly larger than the group of balls. Further, a racking frame that is used at one location may differ from a racking frame used at another location. If the racking frame is large, to tighten the ball formation a player will urge the balls together by use of their fingers. However, when the player removes their fingers from racking frame, movement of the balls may inadvertently occur. The act of compacting the formation of balls within the racking frame such that they are set tightly together is commonly known as "tightening". This technique allows for the maximum transfer of energy from the cue ball to the balls in formation, and provides a disperse spread of balls across the playing surface.

Known prior art dated back to 1880 includes patents drawn to the billiard or pool game. U.S. Pat. No. 230,652 disclosed a method of facilitating an arrangement of fifteen pool balls in an equilateral triangle so that they all touch or nearly touch each other. The frame consists of an equilateral triangular frame composed of three strips of wood, and with a bottom or slide adapted to the frame so as to be capable of being moved laterally into and out thereof, so that when within the frame such bottom, with the frame, shall constitute a shallow box or triangular tray for receiving the balls and causing them to assume positions relative to each other.

U.S. Pat. No. 501,256 disclosed a wood or metal triangle for billiard balls which contains a hinge bottom, so that the balls can be placed on the table in a closed triangle, and then the triangle can be unhinged and removed without disturbing the balls.

U.S. Pat. No. 1,725,494 directed to a pool ball positioning frame with a base and two sides that are hinged to the base at opposite ends. There is a spring associated with each of the pivotal mountings, urging the sides inwards towards the base so that when all of the fifteen balls are gathered in between the base and the two sides, the triangle will tend to automatically position the balls in proper pyramidal arrangement, and the handles on each side member will assist when grasped and manipulated against the action of the springs. In addition, the sides are slightly shorter than the base, thus allowing the frame to be folded compactly when out of use.

Numerous products have been developed for racking billiards balls or assisting therewith. Unfortunately, these devices often have a complicated structure and are expensive in construction. Reference may be had to U.S. Pat. No. 3,672,671 that uses inclined walls within the rack to create downward pressure on the playing balls. U.S. Pat. No. 6,595,862 uses inclined walls within the rack to create downward pressure on the playing balls and further uses lifting levers to ensure that the compact formation of playing balls is not disturbed upon removal of the rack. U.S. Pat. Nos. 5,601,495 and 5,735,750 use inclined walls to create downward pressure on the playing balls, and use springs to push the rack upward and away from the playing balls once the formation is compacted. U.S. Pat. No. 5,556,341 uses angled packing bars to create downward pressure on the playing balls. U.S. Pat. No. 5,997,404 discloses the use of individual pressure pins to create downward pressure on each individual playing ball. U.S. Pat. No. 3,992,005 that discloses a rack that uses horizontal pressure to compact the playing balls.

U.S. Pat. No. 3,423,087 discloses a billiard ball rack having a triangular frame and a removable bottom so that when the balls are arranged in the rack and placed upon the pool table in the proper location, the balls may be dropped onto the table simply by withdrawing the bottom. The frame has slots in two of the side elements and a bottom wall pivoted at an apex between a rear wall and one of the side walls, and a latch normally latching the bottom wall in closed position and manually operable to release a biasing element for swinging the bottom wall to open position.

U.S. Pat. No. 5,376,054 discloses a billiard ball rack for shaping a group of billiard balls on a pool table. This patent discloses leg members which when in a storage position enables the rack to be used as a standard triangular fifteen ball rack yet when moved to an alternate position, such leg members in combination with other rack portions enables the rack to be alternately used as a diamond shape nine ball rack.

U.S. Pat. No. 7,491,130 discloses a billiard/pool ball rack assembly consisting of a triangular rack and a detachable bottom plate and when joined, serves as a tray to encase the balls. When racking the pool balls, the unit is placed on the playing surface then the bottom plate is released from the triangle while the triangle along with the balls are rolled off the plate to the racking spot and the bottom plate which is now serving as a measuring gauge and is resting at the foot rail. Then the triangle with balls is backed up against the bottom plate and the triangle is lifted away from the balls for an accurate racking.

U.S. Pat. No. 5,916,032, discloses a combination billiard rack convertible between two game configurations, such as a 15-ball configuration and a 9-ball configuration. The rack includes two side members and a base member that form an equilateral triangle defining an interior area in a plane of the rack capable of receiving and racking a plurality of billiard balls. Pivotal arms are provided on each of the side members. Each is pivotal about one fixed end at a location near a mid-point of each side member for pivotal movement about the fixed end in the plane of the rack. The arms are pivotal between a first position in which each arm is parallel with corresponding side members and a second position located within said interior area in which the arms are non-parallel with corresponding side members and act with the side members and base member to form an internal area of a size smaller than the first configuration. One or more movable arms can be provided on the base member to allow fuller motion of the pivotal arms. The rack can be locked in either of the two configurations in a releasable manner.

U.S. Pat. No. 5,556,341 discloses a billiard rack wherein balls are compressed towards the center of the rack from all sides of the rack simultaneously. The billiard ball rack has a retractable actuator that activates packing bars to compress the balls, and resets the packing bars to their original position after compression. The packing bars have an angled edge for seating the balls into the table surface when the retractable actuator is actuated. Additionally, this patent discloses a method of compacting balls by urging the balls from at least three sides to the center of a frame.

U.S. Patent Publication No. US 2002/0107076 A1, discloses a billiards ball rack including a frame having a plurality of side walls forming an opening. A plate is attached to a top surface of the frame, and includes inwardly and downwardly directed inclined surfaces for engaging an outer periphery of a group of billiards balls to compact the billiards balls into a desired configuration. The inclined surfaces define a cut-out portion of the plate, typically a triangle or diamond. The rack includes lifting levers pivotally attached to two side walls of the triangular frame. When a handle segment of the lever is grasped and pulled upward, a lower foot segment pivots and extends below a base of the frame to lift the frame from the playing surface, leaving the compacted billiards balls in the desired configuration on the billiard table.

U.S. Pat. No. 5,871,405 discloses a pool ball racking system for tightly and evenly racking a set of pool balls in preparation for a beginning player's break. The system comprises an equilateral triangular racking frame within which the set of pool balls are placed. The racking frame is placed upon a napped felt surface of a pool table, with the pool balls located therein. A vibrating device secured to the racking frame is activated and causes the pool balls to resonate and settle into the nap of the felt surface, thus firmly setting the pool balls in place.

U.S. Pat. No. 5,529,540 discloses a billiards ball rack for assisting a user in racking billiard balls on a billiards table. The billiards ball rack preferably includes a bottle cap shaped shell having a circular outer wall with a plurality of ridges. A display wall, which can be used for advertising or otherwise displaying information, extends inwardly from the outer wall and ends in a ball rack portion. The ball rack portion includes side walls arranged in an appropriate configuration to rack the billiards balls prior to initiating the game.

U.S. Pat. No. 4,469,328 discloses a racking frame for one or more different billiard games wherein each of the games has a different placement of the balls at the outset. The device being substantially triangular is convertible to the starting configurations of each of the games by the hinged overlaying triangular member moving rotationally about its hinge point. Additionally, the external surface of the device has indentations for the placement of billiard balls in a newly created game.

U.S. Patent Publication No. US 2009/0029787 A1 discloses a device such as a snooker, pool or billiards ball rack for setting such balls in a formation for play. The device comprises a frame for receiving said balls and positioning the balls in formation. A display member is also provided which has indicia provided thereon and which is mountable to the frame to display said indicia. The indicia are typically in the form of commercial advertising indicia and/or corporate trademarks and/or logos, but may also convey a variety of information to the players and/or spectators of the game of snooker, pool or billiards.

The prior art references cited above use various mechanical means to compress the formation of balls within the rack and illustrate the lack of commonality. What is lacking in the art is a very important aspect of the framing rack, namely portability. Thus, what is needed is racking frame kit that can be easily disassembly to allow for transportability yet provide an exacting frame that allows an individual player to obtain the repeatability necessary for tightening the formation of balls within the racking frame kit to obtain the maximum transfer of energy from the cue ball to the balls in formation and provide a disperse spread of balls across the playing surface.

SUMMARY OF THE INVENTION

The present invention relates to a racking frame kit for use in the game of billiards, pool or snooker. In particular, the racking frame kit allows for ease of disassembly wherein the player can easily transport a racking frame kit from location to location. The racking frame kit generally comprises a frame having a plurality of relaseably attached side walls which form an opening for engaging an outer periphery of a group of billiards balls to compact them into a desired configuration.

In accordance with the present invention, there is provided a racking frame kit for arranging and compacting a group of balls into a predetermined pattern comprising a frame with a first side wall, a second side wall and a third side wall, and a means for coupling the side walls into a triangular pattern without changing of dimensional tolerances.

In one embodiment, the racking frame kit places a plurality of balls within the confines of the frame and reduces the length of at least one side wall by pushing at least one side wall toward the plurality of balls such that the plurality of balls are arranged and compacted into a predetermined pattern.

In another embodiment the racking frame kit places a plurality of balls within the confines of the frame which are secured together by magnets.

Another embodiment requires the racking frame kit to place a plurality of balls within the confines of a frame that is secured together by furniture grooves.

Thus, an objective of the invention is to provide a transportable racking frame capable of arranging and compacting a group of balls into a predetermined pattern.

Still another objective of the instant invention is to provide a racking frame kit capable of providing compression to create a tight grouping of playing balls.

Still another objective of the invention is to provide a racking frame kit having releasable hinge mechanisms pivotally attached at the end of each side wall to allow fixed compression or active compression.

Another objective of the present invention is to provide an improved racking frame kit for compacting a formation of playing balls using horizontal pressure.

It is another objective of the present invention to provide an improved racking frame kit that allows for removal of said rack without disturbing the formation of playing balls.

Still another object of the present invention to provide an improved racking frame kit that will fit into a standard rack holder found in billiard halls.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
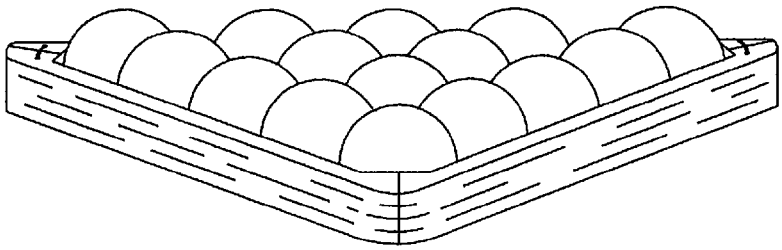
FIG. 1 is a perspective view of a latch racking frame kit embodiment.
Figure 2:
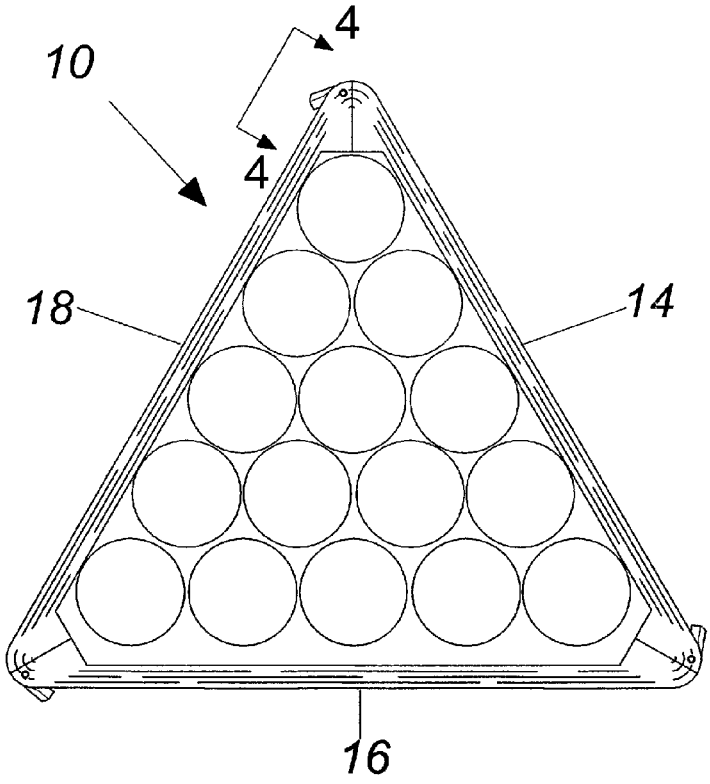
FIG. 2 is a perspective view of the latch racking frame kit embodiment.
Figure 3:
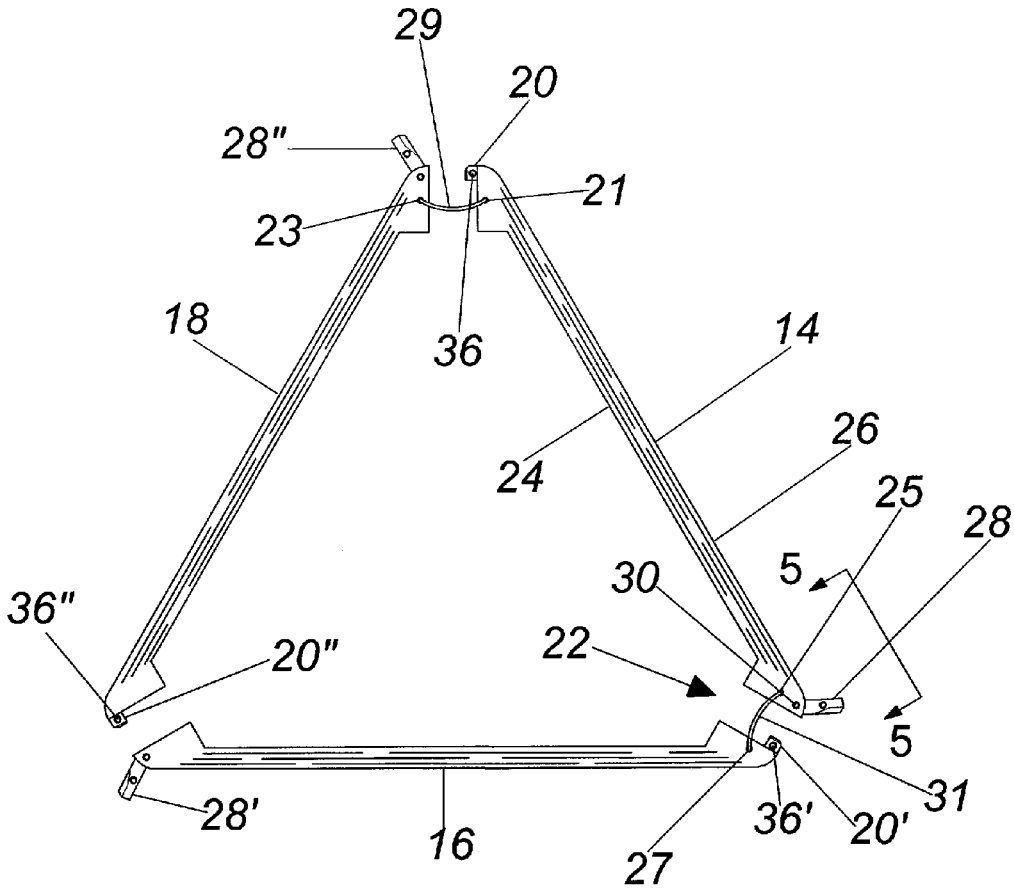
FIG. 3 is an exploded view of the latch racking frame kit.
Figure 4:
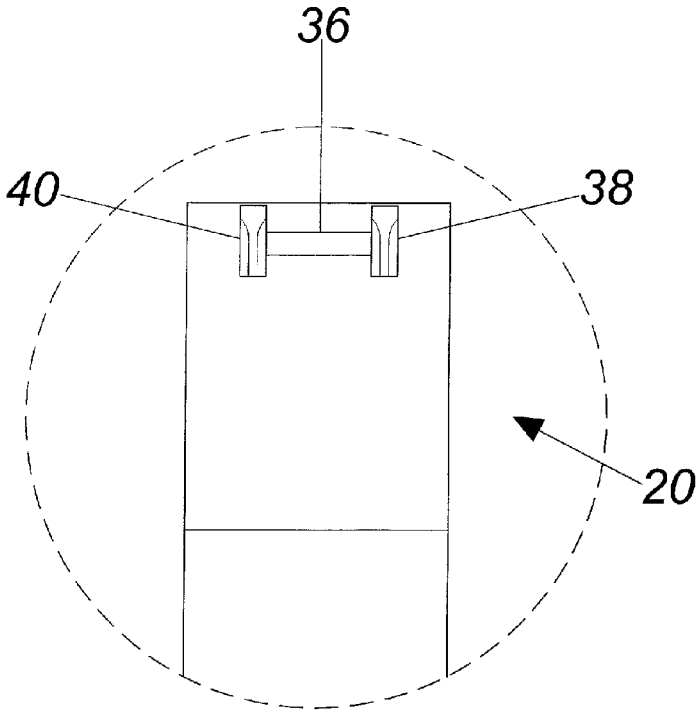
FIG. 4 is a side view of the latch member tab.
Figure 5:
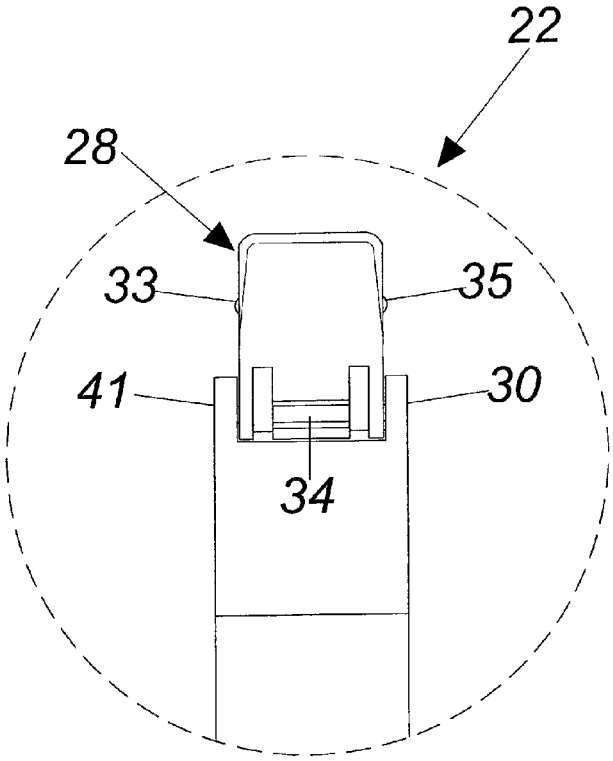
FIG. 5 is a side view of the latch member clasp.
Figure 6:
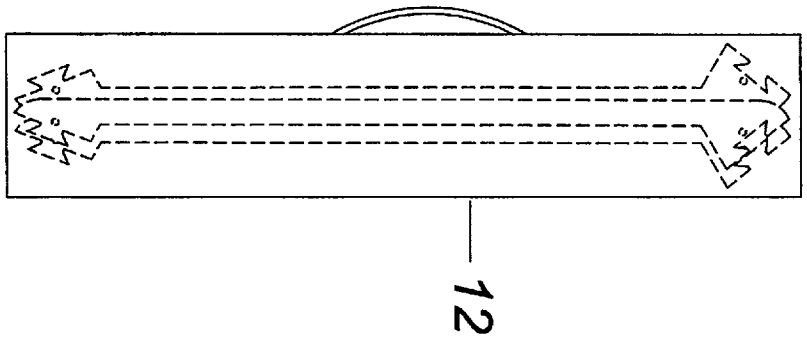
FIG. 6 is a pictorial view of a storage container.

Now referring to the drawings, set forth is a first embodiment of the instant invention consisting of a racking frame kit 10 that fits within a storage container 12. The frame kit is defined by three similarly shaped side members 14, 16, and 18, each side member having a length, width and height that is equal in size between the members. Side member 14 has a first end 20 and a second end 22 with a generally upright configuration defined by an inner surface 24 and an outer surface 26. The inner surface 24 may be inclined to assist in compressing of balls in a tighter configuration, as will be further defined. The first side member 14 is illustrated of each side member and includes a lifting lever 28 having a pivot point 30 along the second end 22 of the side member, said lifting lever including a capture point 34 which has the same axis as the pivot point 30. The first end 20 includes an attachment rod member 36 extending between a first and second tab 38, 40 extending from the first end 20.

By way of illustration the side member 14 is attached to adjoining side member 16 by placement of the lifting lever 28 over rod 36' when lifting member 28 is rotated around pivot points 30 so as to lock the second end 22 of first member 14 to the first end 20' of the adjoining side member 16. Similarly the first end 20 having rod member 36 is available for securement to an adjoining third frame member 18 having lifting lever 28" by latching to rod 36. The lifting lever preferably includes detents 31 and 33 which allow the lifting lever to be secured in position by placement within a grove 41 located on either side of the latch member.

Adjoining side member 16 is attached to side member 18 with lifting lever 28', securable to rod member 36" so as to form an equal lateral triangle adapted to receive a group of 15 balls on a compact state within the side members. The grouping of balls in a compact state allows the player to have a predictable grouping that he is familiar with an as the expertise of the player increases the correct grouping provides a predictable break when the grouping of balls is struck by a queue ball.

The lifting lever can be loosened on one of the side members so that when the grouping of balls is placed within the latch member can then be operated so as to place the grouping of balls in a compressed state and unlatched so that the movement of the balls is not disturbed when the rack is removed. When play is complete the side members 14, 16 and 18 can be unlatched and placed in a disassembled state and placed into a storage container 12 for ease of transport as well as to protect the side members from damage.

A flexible member 29 having a first end 21 and second end 23 may be secured between the first end 20 of first member 14 and second end 22" of the third member 18, respectively. Similarly, a flexible member 35 having first end 25 and second end 27 may be secured between second end 22 of first member 14 and first end 20' of second member 16. When the side members 14, 16, and 18 are unlatched and placed in a disassembled state, the flexible members 29 and 31 binds together side members 14, 16, and 18 thereby keeping the side members bunched together when placed in a disassembled state.

Figure 7:
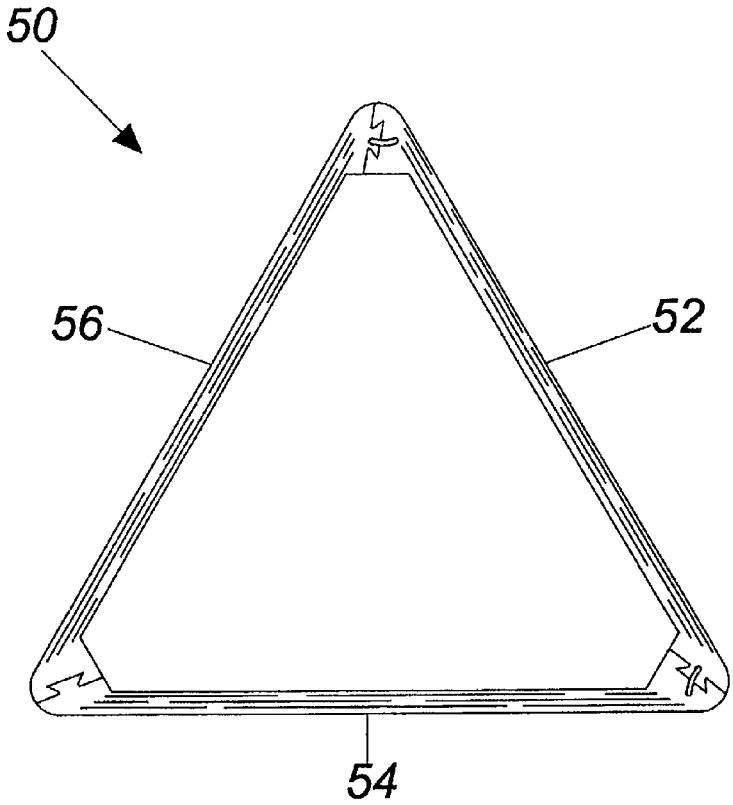
FIG. 7 is a perspective view of a groove racking frame kit embodiment.
Figure 8:
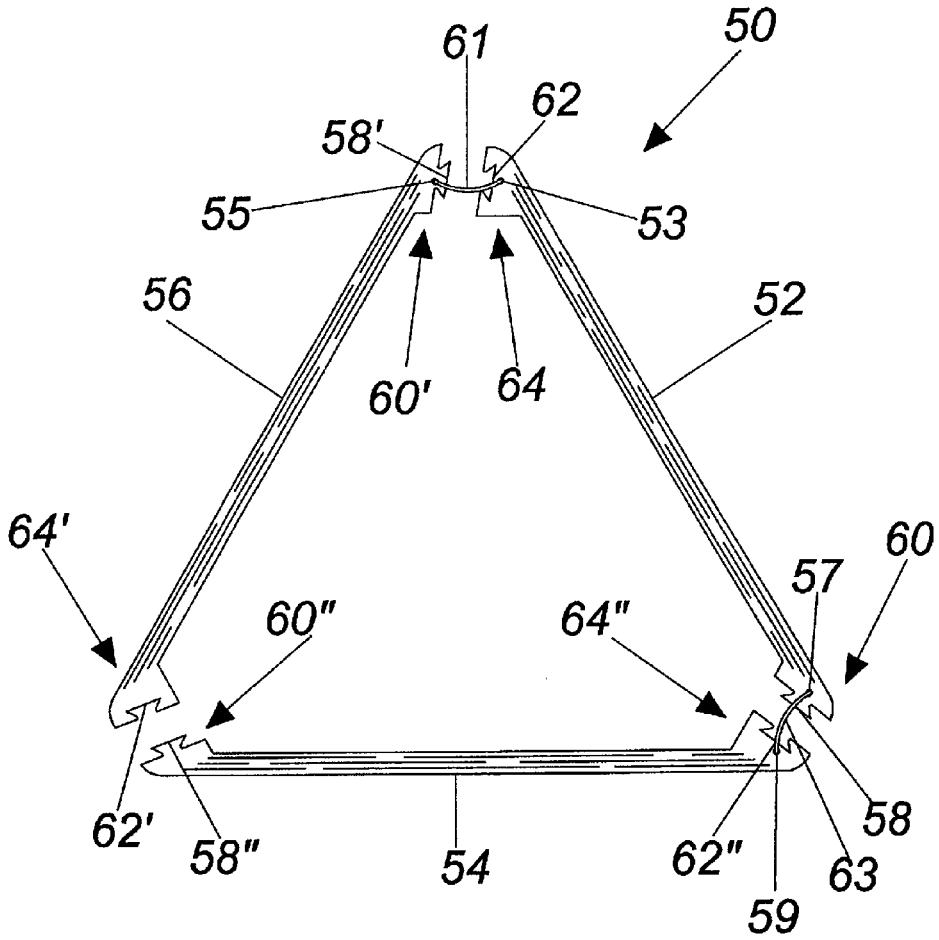
FIG. 8 is an exploded view of the groove racking frame kit embodiment.

Referring now to FIGS. 7 and 8, set forth is second embodiment of the instant invention wherein the equilateral triangle racking frame kit 50 is formed from a first side member 52, a second side member 54, and a third side member 56. First side member 52 being illustrative of the invention having a tongue 58 along a first end 60 in a grove 62 disposed along a second end 64. The first end 60 is securable to a second end 64" of side member 54 by placement within grove 62," similarly a first end 60" having a tongue 58" is securable to third member 36 having a second end 64' with a grove 62'. Side member 56 is securable to adjoining side member 52 with first end 60' having tongue 58' securable to grove of side member 52 along end 64. The tongue and grove assembly maintains exact dimension for the player while assembled forming an equal lateral triangle pattern enclosure available for a seed of a group of balls. As with the previous embodiment, the disassembly of the individual members allows placement within a storage container 12 for use of transport.

A flexible member 61 having a first end 53 and second end 55 may be secured between an end 64 of first member 52 and an end 60' of the side member 56, respectively. Similarly, a flexible member 63 having a first end 57 and second end 59 may be secured between an end 60 of side member 52 and an end 64" of second member 54. When the side members 52, 54, and 56 are placed in a disassembled state, the flexible members 61 and 63 binds together side members 52, 54, and 56 thereby keeping the side members bunched together when placed in a disassembled state.

Figure 9:
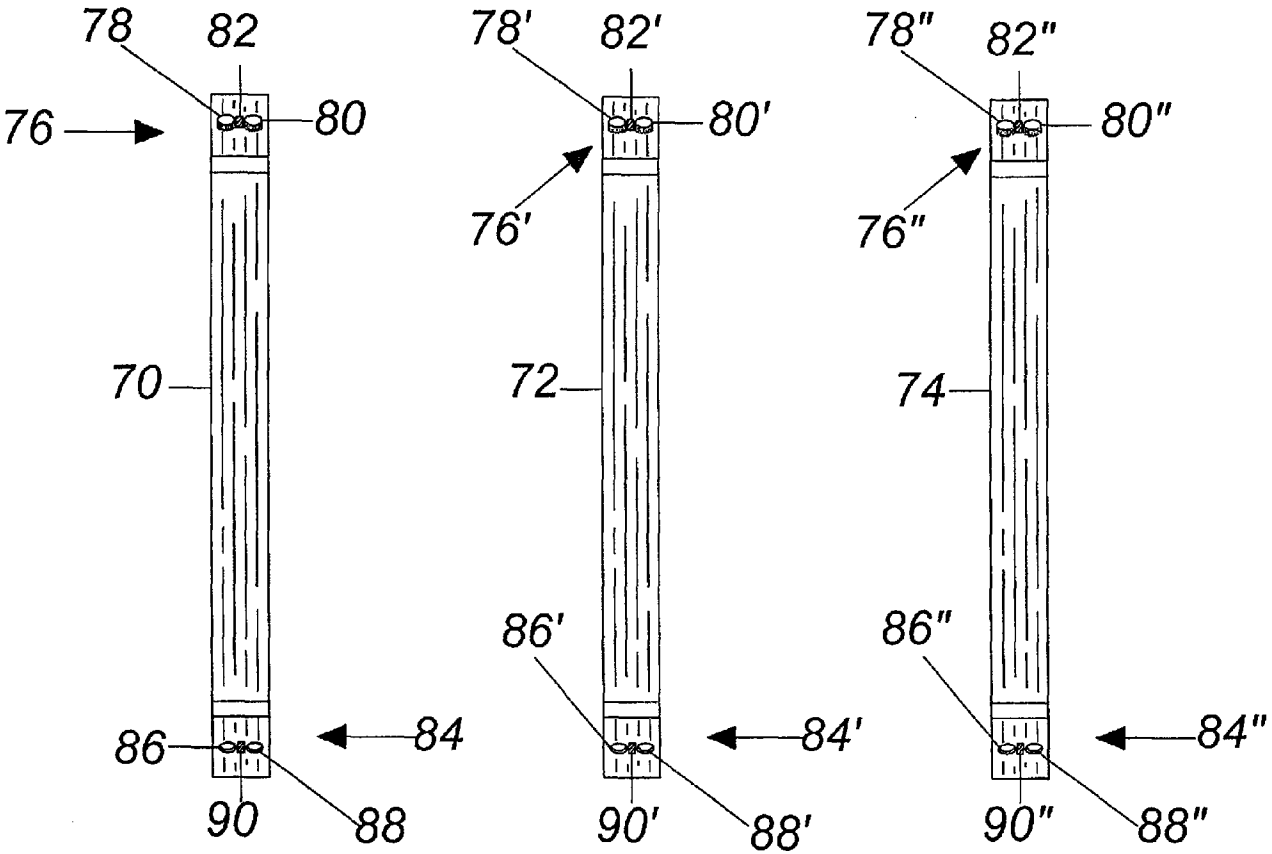
FIG. 9 is a perspective view of a magnet racking frame kit embodiment.
Figure 10:
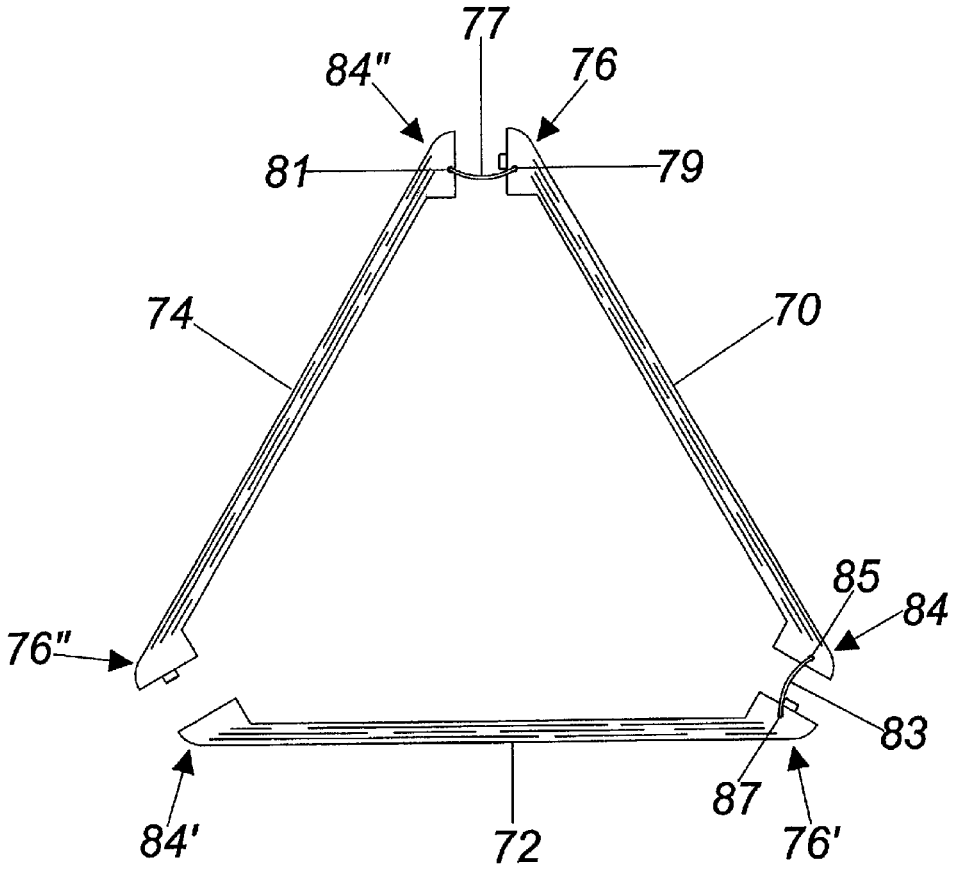
FIG. 10 is an exploded view of the magnet racking frame kit embodiment.

Now referring to FIGS. 9 and 10, set forth is a third embodiment of the instant invention having side members 70, 72 and 74. Side member 70 includes a first end 76 having protrusions 78, 80 placed on either side of a magnet 82. As second end 74 has receptacles 86, 88 placed on either side of an integrated metal 90 portion. Second member 72 has a first end 76' with protrusions 78' and 80' placed on each side of magnet 82' and a second end 84' having receptacle 86' and 88' placed on either side of medal insert 90'. Third side member 74 has protrusion 78" and 80" placed on either side of magnet 82" and second end 84" having first receptacle 86" and second receptacle 88" placed on either side of metal insert 90". The first end of side member 70 is securable to the second end of side member 72, the first end of side member 72 is securable to second end of side member 74 and first end of side member 74 is securable to second end to side member 70 there by forming the equilateral triangle enclosure for receipt of a grouping of balls in a compressed state. The magnet 82 allows one member to attach to an adjoining member with the protrusion 78 insertable into corresponding receptacles during assembly thereby providing a racking frame that is easily assembled and provides a repeatable structure that an experienced player will understand to provide a predictable packing assembly when transported from place to place.

A flexible member 77 having a first end 79 and second end 81 may be secured between an end 76 of side member 70 and an end 84" of the side member 74, respectively. Similarly, a flexible member 83 having a first end 85 and second end 87 may be secured between an end 84 of side member 70 and an end 76' of second member 72. When the side members 70, 72, and 74 are placed in a disassembled state, the flexible members 77 and 83 binds together side members 70, 72, and 74 thereby keeping the side members bunched together when placed in a disassembled state.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A racking frame kit comprising:

a storage container;

three shaped side members having a length defined by a first end and a second end constructed and arranged for placement within said storage container, each said side member being of a generally upright configuration and having opposed inner and outer surfaces; and lifting levers pivotally attached to the first end of each side member and an attachment hook secured to the second end of each side member for releasably coupling said first end of one of said side members to a second end of an adjoining side member releasably coupling said first end of one of said side members to a second end of an adjoining side member;

wherein coupling the first end of one of said side members to the second end of an adjoining side member forms an equilateral triangular patterned enclosure available for receipt of a group of balls.

2. The racking frame kit according to claim 1 wherein said equilateral triangle is adapted to receive a group of fifteen balls in a compact state.

3. The racking frame kit according to claim 1 wherein said inner surfaces of said side members are inclined.

4. The racking frame kit according to claim 1 wherein said lifting levers and said attachment hooks are positioned generally opposite one another so that the end of each side member is drawn toward each other when in a latched position for placing a group of balls in a compressed position and when in an unlatched position to allow ease of removal from said group of balls.

5. The racking frame kit according to claim 1 wherein said first end of each side member includes at least one tab and said second end of each side member includes at least one receptacle, wherein said second end receptacle is for receipt of said first end tab.

6. A racking frame kit comprising:

a storage container;

three shaped side members having a length defined by a first end and a second end constructed and arranged for placement within said storage container, each said side member being of a generally upright configuration and having opposed inclined inner surfaces and outer surfaces;

lifting levers pivotally attached to said first end of each side member and an attachment hook secured to said second end of each side member;

wherein said lifting levers and said attachment hooks are positioned generally opposite one another so that the ends of each side member is drawn toward each other when in a latched position forming an equilateral triangular patterned enclosure available for receipt of a group of balls in a compressed position and when in an unlatched position to allow ease of sidewall removal from said group of balls.

7. The racking frame kit according to claim 6 wherein said first end includes at least one tab and said second end includes at least one receptacle, wherein said second end receptacle is for receipt of said first end tab.

8. The racking frame kit according to claim 6 wherein said first end of one side member is bound by a flexible member to said second end of an adjoining side member, and said second end of said one said side member is bound by a flexible member to said first end of another adjoining side member.

* * * * *